United States Patent [19]

Woodcock

[11] 4,193,358

[45] Mar. 18, 1980

[54] TUFTING MACHINES

[75] Inventor: Douglas G. Woodcock, Blackpool, England

[73] Assignee: Edgar Pickering (Blackburn) Limited, Blackburn, England

[21] Appl. No.: 929,780

[22] Filed: Jul. 31, 1978

[30] Foreign Application Priority Data

Aug. 5, 1977 [GB] United Kingdom ..... 33011/77

[51] Int. Cl.[2] ..... D05C 15/00

[52] U.S. Cl. ..... 112/79 A

[58] Field of Search ..... 112/121.11, 79 A

[56] References Cited

U.S. PATENT DOCUMENTS

| | | | |
|---|---|---|---|
| 3,103,187 | 9/1963 | Hammez | 112/79 A |
| 3,103,903 | 9/1963 | Broadrick et al. | 112/79 R |

FOREIGN PATENT DOCUMENTS

| | | | |
|---|---|---|---|
| 735019 | 12/1952 | United Kingdom | 112/79 A |
| 780370 | 7/1957 | United Kingdom | 112/79 A |
| 1238846 | 7/1971 | United Kingdom | 112/79 A |

*Primary Examiner*—Ronald Feldbaum

*Attorney, Agent, or Firm*—Cushman, Darby & Cushman

[57] ABSTRACT

A tufting machine, which produces in fabric to be tufted a pattern of varying pile height repeated across the width of the fabric and which includes a border control mechanism whereby the machine can be conditioned to interrupt patterning periodically and form transverse borders between repeats of the pattern.

5 Claims, 10 Drawing Figures

TUFTING MACHINES

This invention provides a tufting machine of the kind comprising feed rollers for supplying yarns to the needles of the machine, speed control means for causing the feed rollers to feed the yarns at alternative speeds under control of a patterning mechanism to cause the needles to form pile of different heights in different areas of the fabric to be tufted in accordance with a pattern determined by the patterning mechanism, and a tube system which feeds the yarns to the needles to provide repeats of the pattern across the width of the fabric.

In known machines of this kind the feed rollers are driven by alternatively engageable clutches under control of the patterning mechanism as described, for example, in British Specifications Nos. 735019 and 780370.

The present invention has for its object to provide a machine which can produce a tufted fabric, e.g., a carpet, which can be subdivided into individual pieces having borders at their ends which do not bear the pattern determined by the patterning mechanism.

The invention accordingly provides a tufting machine of the above kind which includes a border control mechanism operative, each time the pattern has been repeated a predetermined number of times lengthwise of the fabric, to free the speed control mechanism from control by the patterning mechanism for a predetermined number of strokes of the needles.

Preferably the border control mechanism includes presettable means for determining the height of pile produced during operation of the border control mechanism.

According to a further feature of the invention, the machine may also include, for the purpose of providing longitudinal borders, further variable speed feed rollers for feeding yarns directly and without passage through the tube system to needles forming tufts in the fabric along longitudinal borders at the edges of the fabric and/or between lateral repeats of the pattern, and presettable control means for controlling the speed of said further feed rollers independently of the patterning control mechanism.

The machine can thus be used to produce a continuous length of tufted carpet which can be subdivided into individual pieces, each having longitudinal and lateral borders which are either of the same pile height throughout or have a pattern of pile height different from that in the main body of the carpet.

Figure 1:
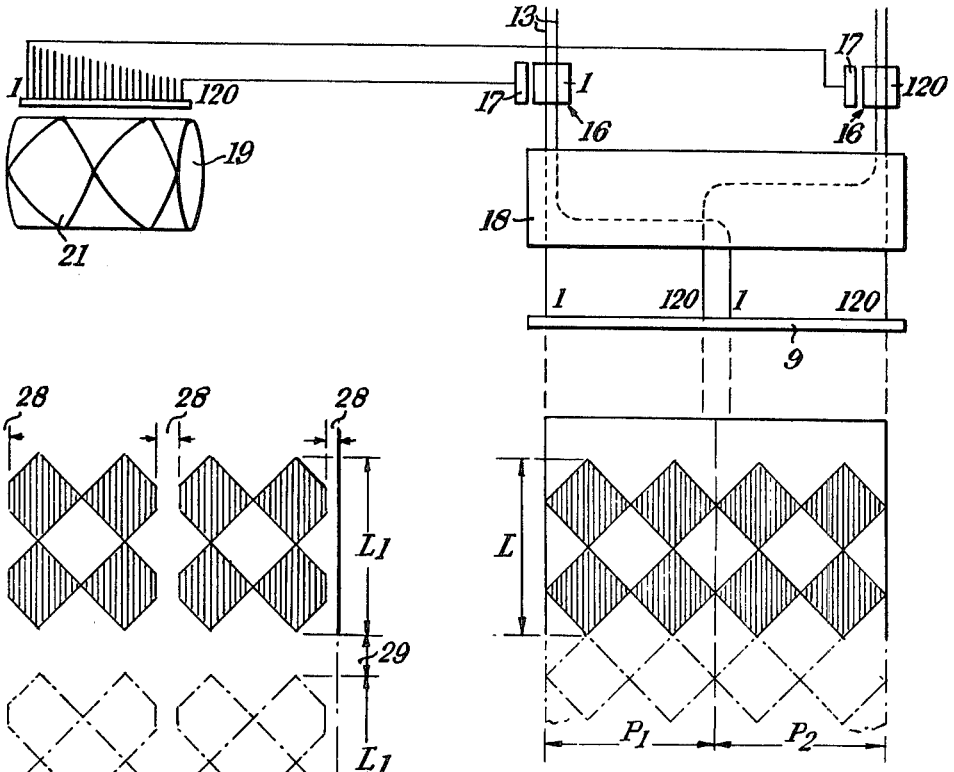
Figure 2:
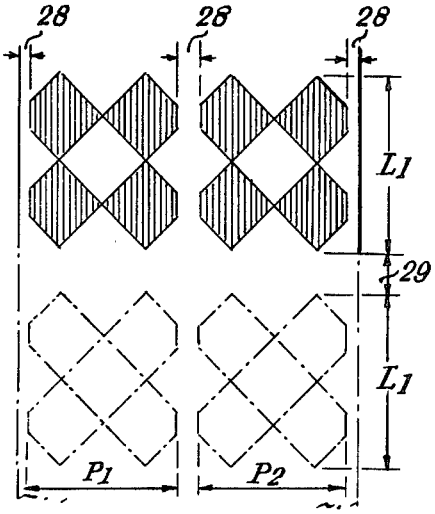
Figure 7:
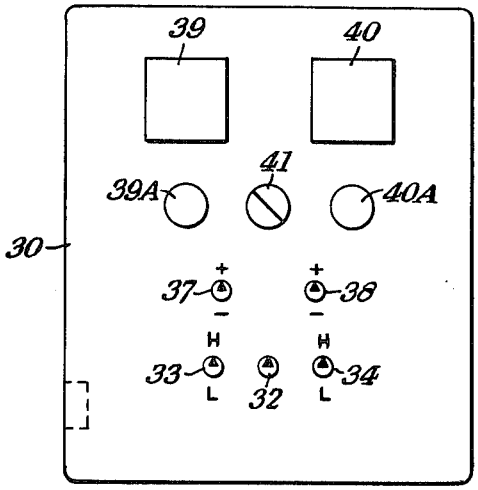
Figure 3:
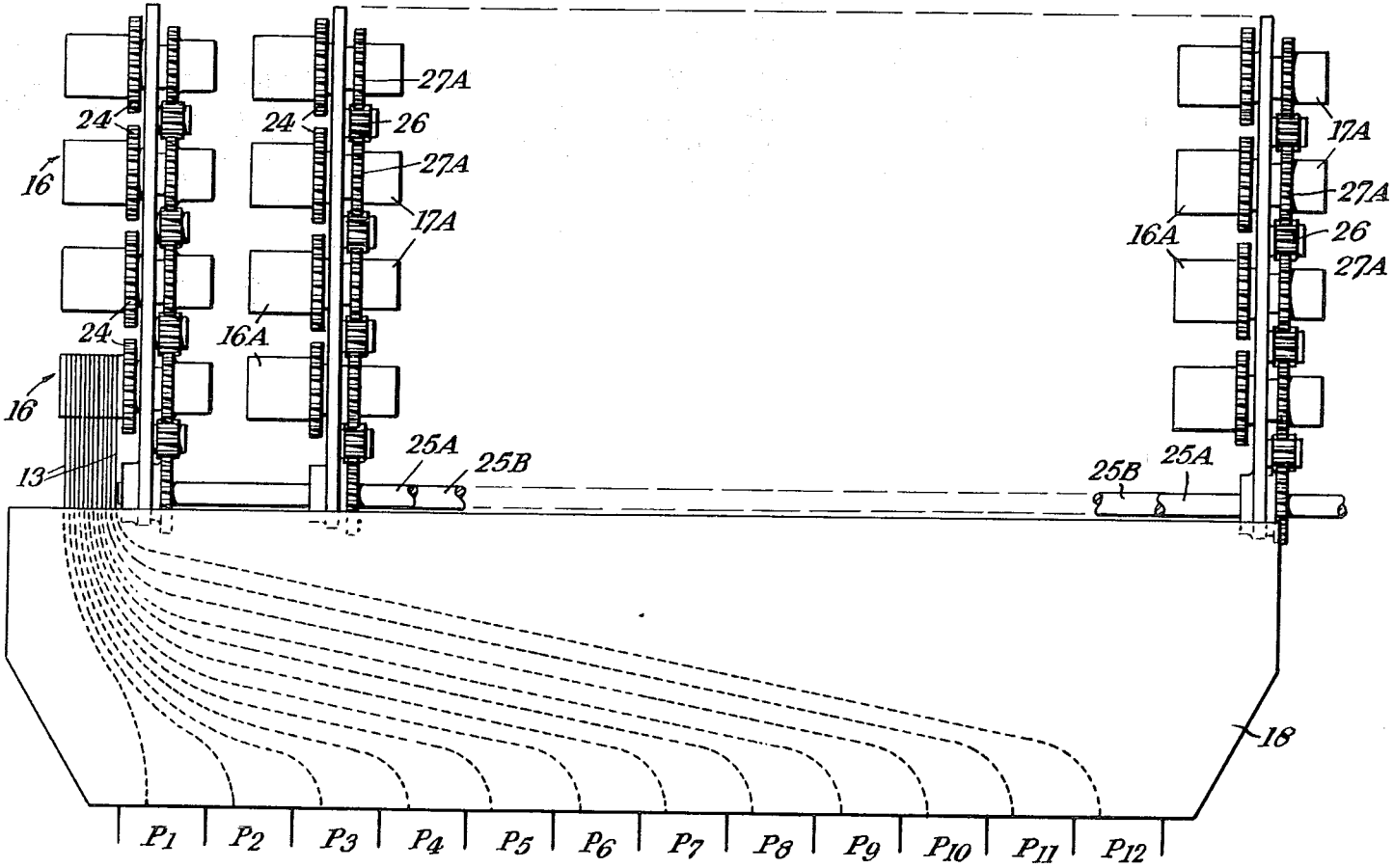
Figure 5:
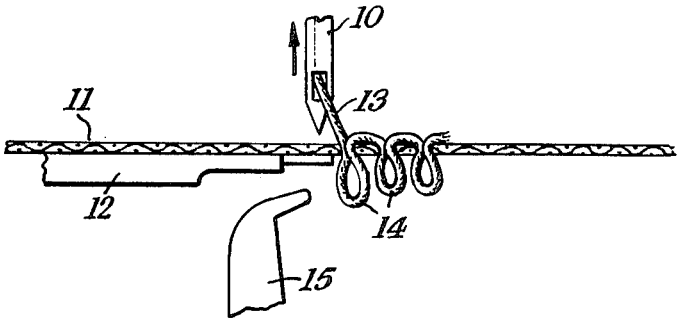
Figure 4:
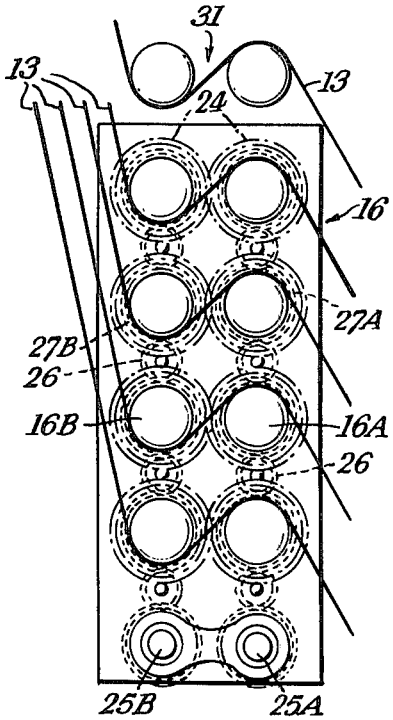
Figure 6:
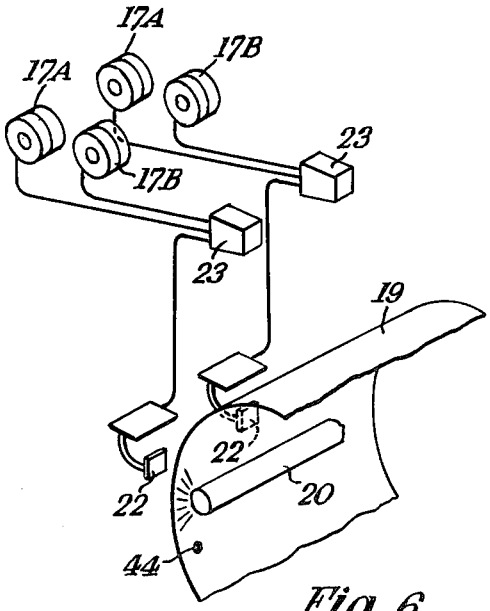
Figure 9:
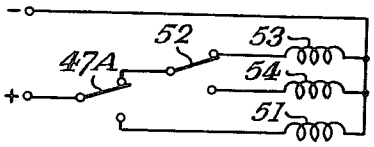
Figure 10:
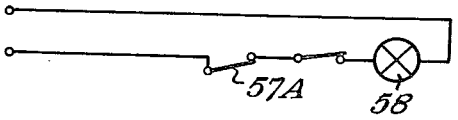
Figure 8:
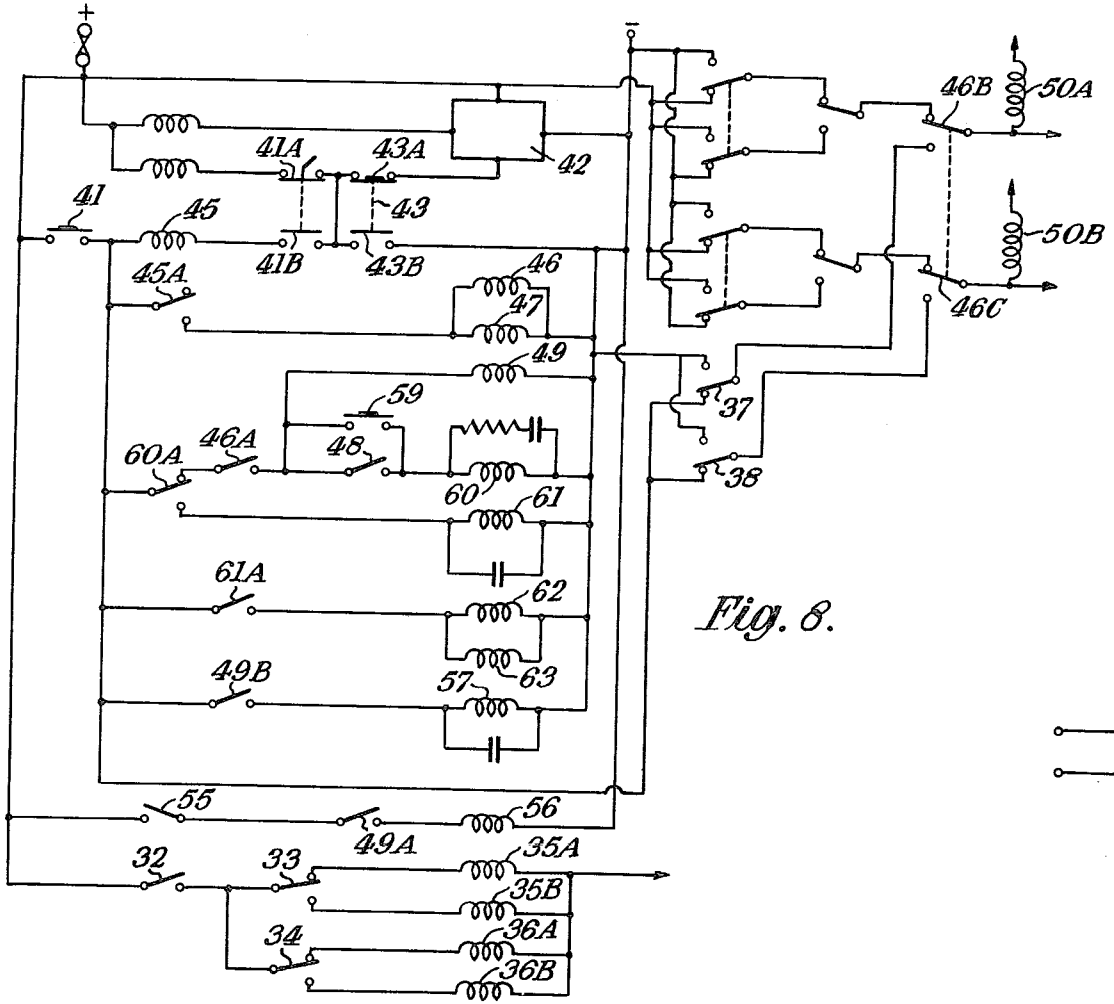

One embodiment of tufting machine according to the invention will now be described in detail with reference to the accompanying diagrammatic drawings, in which:

FIG. 1 is a diagram showing the machine operating to produce a fully patterned tufted fabric which is devoid of borders, FIG. 2 is a diagram showing the pattern produced when the machine is adjusted to produce longitudinal and transverse borders, FIG. 3 is a view illustrating the yarn feed rollers of the machine and their associated clutches, FIG. 4 is a view looking from the left hand side of FIG. 3, FIG. 5 is a view illustrating the formation of loops of yarn by the needles of the machine, FIG. 6 is a view showing part of the patterning control mechanism, FIG. 7 shows a control panel, and FIGS. 8, 9 and 10 are circuit diagrams.

The machine includes, in conventional fashion, a needle bar 9 carrying a row of needles 10 (FIG. 5) which extends transversely to a backing fabric 11 advancing continuously through the machine over a needle plate 12. An individual yarn 13 is fed to each needle, and the needles project loops 14 of yarn through the fabric which are longer or shorter, to produce high or low pile, in accordance with the rate at which yarn is fed to the needles. The loops 14 are retained during the retraction stroke of the needles 10 by loopers 15 in the conventional manner.

As shown in FIG. 1, the yarns 13 are fed to the needle bar 9 by pairs of feed rollers 16, each of which is caused by a clutch mechanism 17 to feed yarns at a higher or a lower rate under control of a patterning attachment. In the case shown in FIG. 1, there are two pattern repeats $P_1$, $P_2$ across the width of the fabric, each of length L, and it is assumed that there are 120 pairs of feed rollers 16, each of which feeds two yarns. The yarns are fed from the feed rollers through a tube system 18, as described in British Specification No. 780370, so that the yarns from feed rollers No. 1 are fed to needle No. 1 of each pattern repeat, from feed rollers No. 2 to needle No. 2 of each pattern repeat and so on, the yarns from feed rollers No. 120 being fed to the 120th needle of each pattern repeat.

The clutch mechanisms 17 are controlled by a pattern drum 19 (see also FIG. 6) having a circumference equal to L, containing an internal light source 20, and carrying around its periphery a pattern sheet bearing the desired pattern 21 in terms of transparent and opaque areas. The clutch mechanisms 17 are operated by a bank of sensors extending along the length of the drum 19 and the mechanism may be set to produce low pile when the drum exposes any particular sensor to light and high pile when the light is cut off from that sensor or vice versa. Each sensor 22 includes a phototransistor controlling a relay 23 which, according to whether light is sensed or not, selects one or other of two electromagnetic clutches 17A, 17B in an associated clutch unit 17 to cause the associated pairs of feed rollers 16 to feed a length of yarn appropriate for low or high pile. The machine may include inverting switches for inverting the pattern of pile heights represented by the pattern on the drum.

In a more elaborate version, providing for three heights of pile, three sets of feed rollers are controlled by two relays giving three outputs which can be selectively energised to provide high, low and medium pile and two pattern drums are provided, the relays associated with the drums being electrically connected to the clutches in such a fashion that the various instantaneous combinations of light and dark in the patterns on the two drums select the three different heights of pile in accordance with a prearranged system. The drum or drums may be rotated continuously to produce consecutive pattern repeats along the length of the cloth, the length of each repeat being equal to the circumference of the drum. Alternatively the drum may be oscillated to and fro to produce alternate mirror images of the design representing the pattern.

As will be seen, full patterning is achieved in the sense that the patterning covers the entire length and width of the fabric.

In the case shown in FIGS. 3 and 4, there are twelve pattern repeats $P_1$–$P_{12}$ across the width of fabric to each of which sixty four yarns are fed. The yarns are accordingly fed by sixty four pairs of feed rollers 16, each of which feeds twelve yarns.

The feed rollers 16A, 16B of each pair are geared together by gears 24 and are associated with a low speed drive shaft 25A and a high speed drive shaft 25B. These drive, through intermediate pinions 26, gears 27A and 27B on the clutches 17A and 17B. Accordingly, each pair of feed rollers 16 will be driven at low or high speed to feed the length of yarn appropriate for low or high pile in accordance with whether its respective clutch 17A or 17B is energised.

It is sometimes desired to produce a tufted carpet which can be subdivided, longitudinally and transversely, into individual rugs or mats, each having longitudinal and lateral borders which are either of the same pile height throughout or have a pattern of pile height different from that in the main body of the carpet.

Such a carpet is shown in FIG. 2 of the drawings. It has longitudinal borders 28 at the edges and between the lateral repeats of the pattern and transverse borders 29 between the longitudinal repeats of the pattern of length $L_1$.

Provision is made for modification of the machine to achieve this result by the inclusion of a control panel 30, illustrated in FIG. 7 of the drawings, an associated electrical control system and additional feed rollers.

When longitudinal borders 28 are required, the yarns required to form the borders are fed directly to the needles concerned, and not through the tube system 18, by further pairs of feed rollers, one of which is shown at 31 in FIG. 4, independent of those controlled by the pattern drum. These pairs of feed rollers 31 are capable of being driven at different speeds by associated clutch mechanisms as in the case of the pairs of feed rollers 16 to produce high or low pile by switches preset by the operator.

To adjust the machine to produce longitudinal borders it is, of course, necessary to rethread the yarns concerned so they extend over pairs of feed rollers 31 instead of over pairs of feed rollers 16. Yarns of different colours are fed to the odd and even numbered needles producing border stitches.

The pattern of pile in the longitudinal borders is controlled by three switches 32, 33, 34 on the control panel 30. The switch 32 serves to switch the longitudinal border control on or off. The switch 33 can be set to select high or low pile from the odd numbered needles providing border stitches. The switch 34 can be set to select high or low pile from the even numbered needles providing border stitches.

As shown in FIG. 8, the switch 33 can select, for operation when the switch 32 has been closed, alternative relays 35A, 35B to cause the odd numbered needles to produce high or low pile and the switch 34 can select alternative relays 36A, 36B to cause the even numbered needles to produce high or low pile.

When it is desired to dispense with longitudinal borders 28 the yarns concerned are rethreaded through pairs of feed rollers 16 controlled by the pattern drum 19 and feeding the yarn through the system 18.

The provision of transverse borders 29 involves periodic interruption of the longitudinal repeats of the pattern and substitution of a selected number of stitches which are of high or low pile as selected by switches 37, 38 on the control panel 30. The system includes two subtractive counters, namely a drum counter 39 and a border counter 40, and associated relays. These counters have associated push buttons 39A, 40A by which they can manually be reset to zero when required.

When a border control switch 41 on the control panel is in the off position, an associated contact 41A (FIG. 8) renders a scanning unit 42 operative to cause the pattern drum 19 to provide full patterning as shown in FIG. 1 and as already described.

When transverse borders are required the counter 39 is set to the number of longitudinal pattern repeats required, the counter 40 is set to the number of rows of stitches required in the borders and the switches 37, 38 are set to positions to determine the height of the pile in the borders and the predominant colour of the pile in the borders. When both switches 37 and 38 are set for low pile height in the borders the predominant colour is a mixture of the colours fed to the odd and even needles, when both switches 37 and 38 are set for high pile the predominant colour is again a mixture of the colours fed to both the odd and even needles, when one switch is set for high pile and the other for low pile the predominant colour will be the colour of the yarn fed to the needles producing high pile.

After these adjustments have been made, the switch 41 is moved to the on position. This opens the contact 41A and closes a contact 41B to bring the scanning unit 42 into operation. The border circuit does not operate at once because a switch 43 associated with the drum counter 39 occupies the position shown in FIG. 8. At each revolution of the pattern drum 19, a light sensor in the scanning unit responds to a black mark 44 on the pattern drum to deduct a unit from the count in the counter 39. When the selected number of longitudinal pattern repeats has been made the count in the counter 39 is reduced to zero. This causes the switch 43 to open a contact 43A to deactivate the scanning unit 42 and to close a contact 43B.

The closing of the contact 43B energises a relay 45 to cause a switch 45A to move to its lower contact to energise relays 46 and 47.

Energisation of the relay 46 closes a switch 46A to supply current to a shaft pulse switch 48 and energises a relay 49. Energisation of the relay 46 also shifts switches 46B and 46C to bring clutch relays 50A, 50B of the odd and even needles under control of the horizontal border switches 37 and 38 thus causing the needles to produce a border pattern in accordance with the setting of the switches 37 and 38.

Energisation of the relay 47 causes a switch 47A (FIG. 9) to move to energise a relay 51 to apply a brake to the drum of the scanning unit to halt the scanning unit. When in its normal position shown in FIG. 9, the switch 47A, energises, in accordance with the position of a switch 52, one of two relays 53, 54 to cause the pattern drum to rotate forwardly or in the reverse direction. Energisation of the relay 49 closes a switch 49A to energise, provided a lamp switch 55 is closed, a lamp relay 56 and switch off the lamp 20 of the scanning unit. In addition, the relay 49 operates a switch 49B to energise a relay 57 which opens a switch 57A (FIG. 10) to prevent a pattern lamp failure light 58 lighting up when the pattern lamp 20 is switched off.

The border counter 40 is under the control of the proximity switch 48 which is associated with the main shaft of the machine and which, by pulsing a coil 60, causes the count in the counter 40 to reduce by one unit for each row of lateral border stitches. When the count in the counter is reduced to zero, a switch 59 closes to short out the relay 49 and the coil 60 changes over to a switch 60A.

The short out of the relay 49 opens the switch 49A to re-light the pattern lamp 20 in the scanning unit. In addition, the relay 57 is deactivated thus rendering operative the pattern lamp failure light 58.

Shifting of the switch 60A energizes a relay 61. This causes a switch 61A to close to energise relays 62 and 63. Energisation of the relay 62 returns the switch 45A to its initial position to deenergise the relays 46 and 47. In addition, the drum counter 39 is reset to its initial count so causing the switch 43 to return to the position shown in FIG. 8. Energisation of the relay 63 resets the border counter 40 to its initial count.

Deactivation of the relay 47 causes the switch 47A to return to the position shown in FIG. 9 to disengage the brake of the pattern drum of the scanning unit and restart the drum in the direction selected by the switch 52.

A further cycle of full patterning will then ensue.

What is claimed is:

1. A tufting machine, comprising feed rollers for supplying yarns to the needles of the machine, speed control means for causing the feed rollers to feed the yarns at alternative speeds under control of a patterning mechanism to cause the needles to form pile of different heights in different areas of the fabric to be tufted in accordance with a pattern determined by the patterning mechanism, a tube system which feeds the yarns to the needles to provide repeats of the pattern across the width of the fabric, a border control mechanism including a first counter for counting the number of repetitions of the pattern in a direction lengthwise of the fabric, a second counter for counting the number of strokes performed by the needles, means operative when the first counter has counted a predetermined number of longitudinal repeats of the pattern to free the speed control mechanism from control by the patterning mechanism so that patterning ceases and means operative when the second counter has counted a predetermined number of strokes of the needles to return the speed control mechanism to control by the patterning mechanism.

2. A tufting machine according to claim 1, wherein the border control mechanism includes presettable means for determining the height of pile produced during operation of the border control mechanism.

3. A tufting machine according to claim 2, wherein the patterning mechanism includes a pattern control drum, bearing on its periphery a representation of the desired pattern in terms of transparent and opaque areas, a light source within the drum and an external optical sensing system for controlling the speed control means, and the border control mechanism includes a subtractive drum counter for counting the revolutions performed by the drum, and the second counter is also a subtractive counter.

4. A tufting machine according to claim 3, wherein the speed control means includes electromagnetic clutches associated with the feed rollers and selectively energisable under control of the patterning mechanism and of the border control mechanism.

5. A tufting machine, comprising feed rollers for supplying yarns to the needles of the machine, speed control means for causing the feed rollers to feed the yarns at alternative speeds under control of a patterning mechanism to cause the needles to form pile of different heights in different areas of the fabric to be tufted in accordance with a pattern determined by the patterning mechanism, a tube system which feeds the yarns to the needles to provide repeats of the pattern across the width of the fabric, a border control mechanism operative, each time the pattern has been repeated a predetermined number of times length-wise of the fabric, to free the speed control mechanism from control by the patterning mechanism for a predetermined number of strokes of the needles, and further variable speed rollers for feeding yarns directly and without passage through the tube system to needles forming tufts in the fabric along longitudinal borders at the edges of the fabric and/or between lateral repeats of the pattern, and presettable control means for controlling the speed of said further feed rollers independently of the patterning control mechanism.

* * * * *